US005967737A

United States Patent [19]

Kraske et al.

[11] Patent Number: 5,967,737

[45] Date of Patent: Oct. 19, 1999

[54] BACKHOE BOOM LOCK

[75] Inventors: Leroy Ernest Kraske, Dubuque, Iowa; Dennis Alan Schaal, Platteville, Wis.; Michael John Kieffer; Robert Gerard Mootz, both of Dubuque, Iowa; Robert Paul Dressler, Lancaster, Wis.

[73] Assignee: Deere & Company, Moline, Ill.

[21] Appl. No.: 08/961,697

[22] Filed: Oct. 31, 1997

[51] Int. Cl.[6] ..... B66F 9/00

[52] U.S. Cl. ..... 414/694; 414/687

[58] Field of Search ..... 414/694, 687

[56] References Cited

U.S. PATENT DOCUMENTS

| | | | |
|---|---|---|---|
| 4,225,282 | 9/1980 | Nordstrom et al. | 414/694 |
| 4,260,321 | 4/1981 | Beauchamp et al. | 414/694 |
| 4,278,394 | 7/1981 | Johnson | 414/694 |
| 4,887,938 | 12/1989 | Menke | 414/694 |
| 5,064,339 | 11/1991 | Ahlers | 414/687 |

*Primary Examiner*—Donald W. Underwood

[57] ABSTRACT

A backhoe boom lock for locking the boom to the swing frame during transporting and craning operations. The boom is provided with two upwardly open hooks that project on either side of the swing frame when the boom is retracted into its craning or transport positions. Two bell cranks are located on each side of the swing frame and are provided with transverse catches for engaging the upwardly open hooks. The bell cranks are biased downwardly by springs. A linkage for lifting the bell cranks against the biasing force of the springs extends from the bell cranks into the interior of the operator's cab. The linkage is provided with a control lever, located inside the operator's cab for lifting the bell cranks. After the boom has been retracted into its transport or craning position, the control lever is released and the bell cranks rotated by the biasing springs so that the catches engage the upwardly open hooks on the boom.

10 Claims, 2 Drawing Sheets

BACKHOE BOOM LOCK

BACKGROUND OF THE INVENTION

1. Field of the invention:

The invention is directed to a backhoe boom lock for locking the boom to the swing frame during transporting and craning operations.

2. Description of the Prior Art:

A variety of work vehicles can be equipped with backhoes for doing excavation work. A backhoe is provided with a pivotal boom which is attached to the vehicle by a swing frame. The swing frame is provided with a vertical pivot for pivoting the backhoe about a vertical axis relative to the vehicle. The boom of the backhoe is joined to the swing frame by a horizontal pivot and can be pivoted relative to the swing frame about a horizontal axis. A dipperstick is pivotally to the boom. The positions of the swing frame relative to the vehicle, the boom relative to the swing frame, and the dipperstick relative to the boom are controlled by hydraulic cylinders. Typically, a bucket is pivotally attached to the end of the dipperstick remote from the boom. A hydraulic cylinder pivotally attached to the dipperstick is used to position the bucket relative to the dipperstick through a bucket linkage.

During transporting operations, as the vehicle is being moved from one job site to another, the boom is locked relative to the swing frame, and the swing frame locked relative to the vehicle. During craning operations, the boom is locked relative to the frame by the swing framer is not locked relative to the vehicle. Various examples of boom locks are disclosed in U.S. Pat. Nos. 4,225,282, 4,260,321 and 5,064,339.

SUMMARY

It is an object of the present invention to provide a simplified boom lock structure for locking the boom relative to the swing frame.

The present invention is used on a work vehicle for locking a boom to a swing frame. The boom is provided with two upwardly open hooks that project on either side of the swing frame when the boom is retracted into its craning or transport positions. Two bell cranks are located on each side of the swing frame and are provided with transverse catches for engaging the upwardly open hooks. The bell cranks are coupled to one another by a rod extending through the swing frame. In addition, the bell cranks are biased downwardly by springs. A linkage for lifting the bell cranks against the biasing force of the springs extends from the bell cranks into the interior of the operator's cab. The linkage is provided with a control lever, located inside the operator's cab for lifting the bell cranks. After the boom has been retracted into its transport or craning position, the control lever is released and the bell cranks rotated by the biasing springs so that the catches engage the upwardly open hooks on the boom. The biasing springs are positioned between the bell cranks and the linkage.

DETAILED DESCRIPTION

Figure 1:
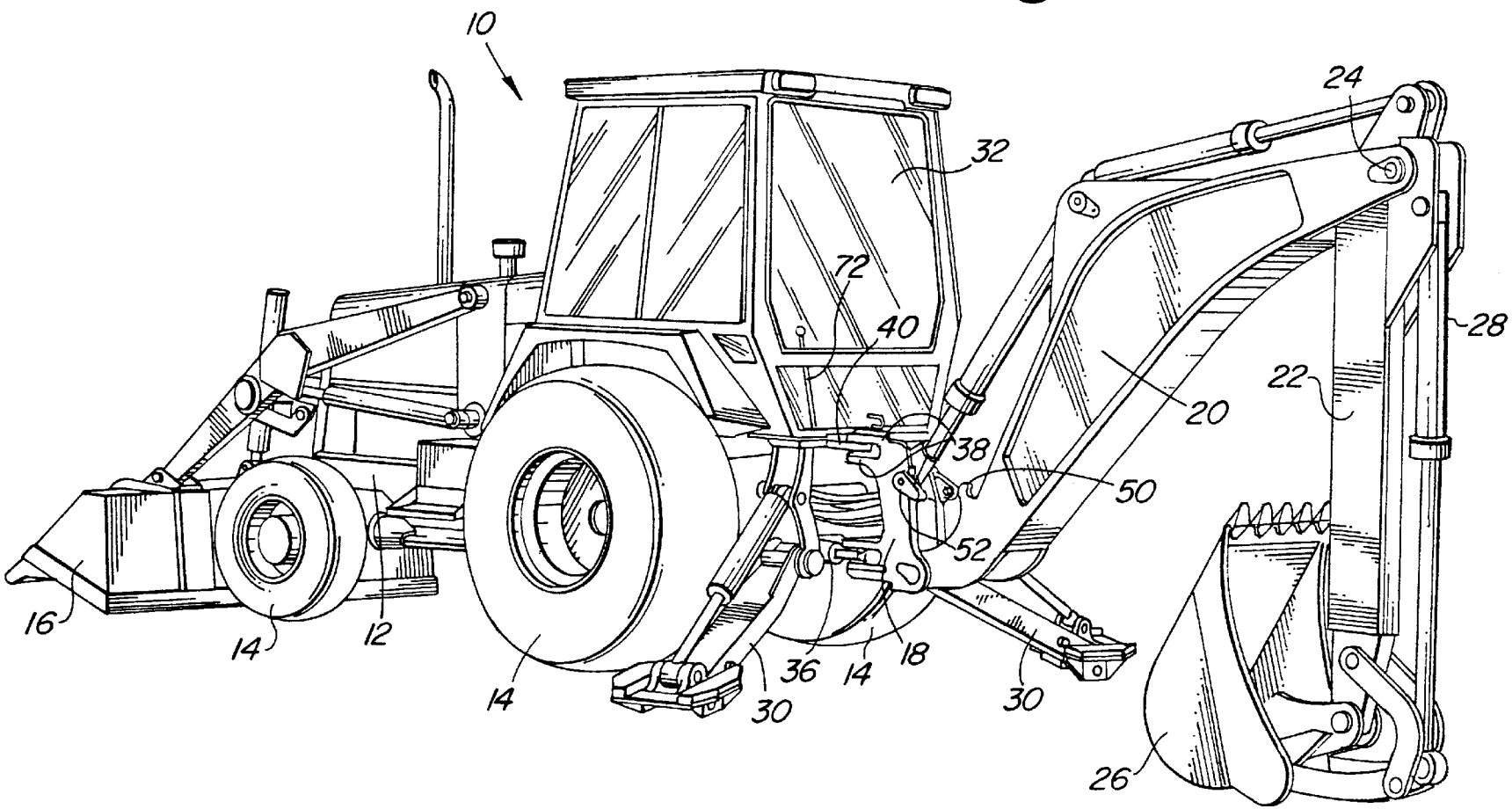
FIG. 1 is a rear perspective view of a backhoe loader.
Figures 2, 3:
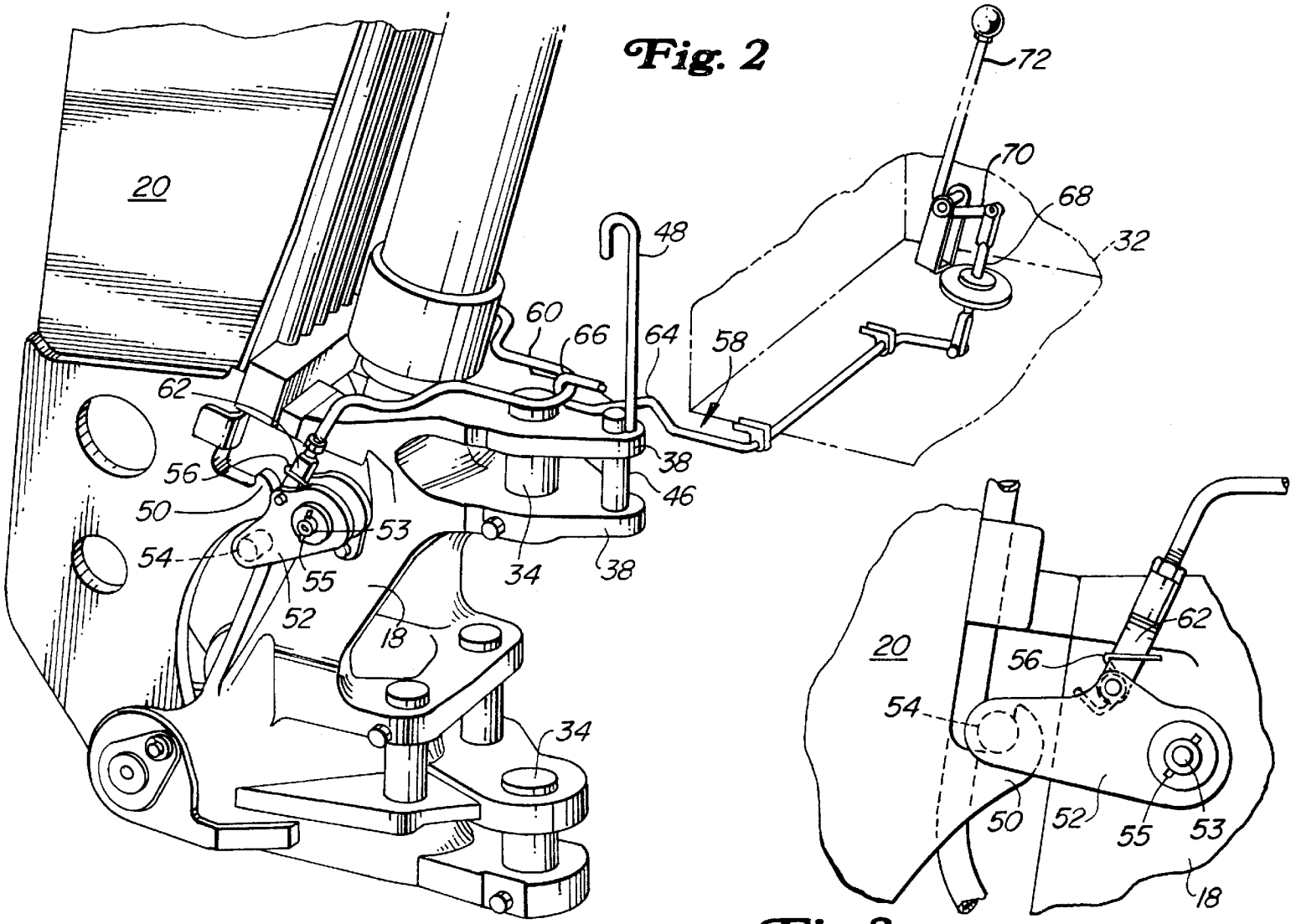
FIG. 2 is a perspective view of the swing frame, boom and control linkage.
FIG. 3 is a side view of the bell cranks engaged with the upwardly open hooks.

FIG. 1 illustrates a work vehicle, such as a backhoe loader 10, having a frame 12 to which are mounted ground engaging wheels 14 for supporting and propelling the frame. Although the current invention is illustrated as being mounted on a wheeled work vehicle, it can also be mounted on a crawler work vehicle or other suitable work vehicles. The backhoe loader is provided with a loader bucket 16 having a suitable loader bucket linkage for manipulating the loader bucket relative to the frame. The rear of the vehicle frame 12 is provided with a swing frame 18. A boom 20 is pivotally coupled to the swing frame 18, a dipperstick 22 is pivotally connected to the boom at pivot 24 and a bucket 26 is pivotally connected to the dipperstick 22. A bucket actuating hydraulic cylinder 28 manipulates the bucket 26 through a bucket linkage. The backhoe loader is also provided with two stabilizers 30. The operation of the vehicle is controlled from operator's cab 32.

The swing frame 18 is pivotally coupled to the vehicle frame 12 by a vertical pivot 34. Hydraulic cylinder 36 pivots the swing frame 18 relative to the vehicle frame 12 about a vertical axis defined by pivot 34. The swing frame is provided with two forwardly projecting portions 38 having vertical pin receiving apertures. A rearwardly extending portion 40 of the vehicle frame 12 is sandwiched between the two forwardly extending portions 38 and is also provided with a vertical aperture. The vertical aperture on the rearwardly extending portion 40 is aligned with vertical pin receiving apertures of the forwardly projecting portions 38 when the swing frame 18 is centered on the vehicle frame 12. When the apertures are aligned, a removable pin 46 having a handle 48 can be inserted into the apertures for locking the swing frame 18 relative to the vehicle frame 12.

The boom 20 is provided with two upwardly open hooks 50 that overlap the swing frame when the boom is retracted into its craning or transport position. Two pivotal bell cranks 52 are mounted on the left and right sidewalls of the swing frame 18. The bell cranks are coupled to one another by a transverse rod 53 extending through the swing frame 18. Pins 55 anchor the bell cranks 52 to the rod 53, so that as one bell crank is rotated the other bell crank is rotated. Each bell crank is provided with a transverse catch 54 for engaging the upwardly open hooks 50. Each bell crank 52 is biased downwardly by springs 56 positioned between the bell crank and the control linkage 58. When the boom 20 is pivoted upwardly, the hooks 50 are not caught by the transverse catches 54 as the bell cranks are biased downwardly the springs and the catches are located below the hooks.

The bell cranks 52 can be lifted against springs 56 by linkage 58. The linkage 58 extends from the bell cranks 52 to the inside of the operator's cab 32. The linkage 58 comprises a generally U-shaped link 60 that is pivotally coupled to both of the bell cranks 52 by yokes 62. U-shaped link 60 is coupled to boom lock control link 64 by the hooked portion 66 of link 64. The boom lock control link 64 is coupled to a straight link 68 that in turn is coupled to the crank portion 70 of control handle 72. Control handle 72 is located in the operator's cab of the vehicle. By pushing the control lever 72 away from the boom 20 the crank portion 70 pushes straight link 68 downwardly rotating boom lock control link 64 and lifting the hooked portion 66. Lifting the hooked shaped portion lifts the U-shaped link 60. Lifting the U-shaped link 60 rotates the bell cranks 52 upwardly against the biasing springs 56. The boom 20 is then brought into its craning or transport position so as the bell cranks are released the transverse catches 54 engage the upwardly open hooks 50 and lock the boom 20 relative to the swing frame 18. The hooked portion 66 of the boom lock control link 64 can only lift the bell cranks 52 against the biasing force of the springs 56.

The invention should not be limited by the above described embodiment, but should be limited solely by the claims that follow.

We claim:

1. A vehicle having a backhoe, the vehicle having a swing frame for pivotally mounting the backhoe on the vehicle on a vertical pivot, the vehicle being provided with an operator's cab from which the operation of the backhoe is controlled, the backhoe having a boom swingably mounted on the swing frame on a horizontal pivot for movement between a transport position and selected working positions, and a hydraulic cylinder operative between the boom and the swing frame for positioning the boom, and improved locking device for selectively locking the boom to the swing frame so the boom is prevented from rotating about the horizontal pivot when in its transport position comprising:

a upwardly open hook mounted on the boom;

a bell crank pivotally mounted on the swing frame, the bell crank is provided with a transverse catch for engaging the upwardly open hook;

a linkage extending from the bell crank into the operators cab, the linkage having a control lever in the operator's cab for lifting the transverse catch a spring assembly is positioned between the bell crank and the linkage for biasing the bell crank downwardly.

2. A vehicle as defined by claim 1 wherein the boom is provided with two upwardly open hooks and the swing frame is provided with two bell cranks each having a transverse catch.

3. A vehicle as defined by claim 2 wherein with left and right sidewalls and one of the bell cranks is mounted on the left sidewall and the other bell crank is mounted on the right sidewall.

4. A vehicle as defined by claim 3 wherein the two bell cranks are coupled to one another by a rod passing through the swing frame.

5. A vehicle as defined by claim 4 further comprising a removable pin for insertion through apertures in the swing frame and the vehicle for preventing rotation of the swing frame about the vertical pivot.

6. A work vehicle for performing a work operation, the work vehicle comprising:

a frame;

an operator's cab mounted to the frame from which the operation of the boom is controlled, ground engaging assembly coupled to the frame for supporting the propelling the frame;

a swing frame pivotally coupled to the frame by a vertical pivot;

a boom is pivotally coupled to the swing frame by a horizontal pivot;

a upwardly open hook mounted on the boom;

a bell crank pivotally mounted on the swing frame, the bell crank is provided with a transverse catch for engaging the upwardly open hook;

a linkage extending from the bell crank into the operator's cab, the linkage having a control lever in the operator's cab for lifting the transverse catch a spring assembly is positioned between the bell crank and the linkage for biasing the bell crank downwardly.

7. A work vehicle as defined by claim 6 wherein the boom is provided with two upwardly open hooks and the swing frame is provided with two bell cranks each having a transverse catch.

8. A work vehicle as defined by claim 7 wherein the swing frame is provided with left and right sidewalls, one of the bell cranks is mounted to the left sidewall and the other bell crank is mounted to the right sidewall.

9. A work vehicle as defined by claim 8 wherein the two bell cranks are coupled to one another by a rod passing through the swing frame.

10. A work vehicle as defined by claim 9 further comprising a removable pin for insertion through apertures in the swing frame and the vehicle for preventing rotation of the swing frame about the vertical pivot.

* * * * *